US005794384A

United States Patent [19]

Dean et al.

[11] Patent Number: 5,794,384

[45] Date of Patent: Aug. 18, 1998

[54] PLASTIC CLIP FOR DOWNSPOUT ATTACHMENT TO VINYL SIDING

[76] Inventors: James L. Dean, 1834 SE. Quail Cir., Hillsboro, Oreg. 97123; Rodney B. Hall, 666 SE. 155th, Portland, Oreg. 97233

[21] Appl. No.: 680,144

[22] Filed: Jul. 15, 1996

[51] Int. Cl.[6] ..... F04D 13/08; F16L 3/123

[52] U.S. Cl. ..... 52/16; 52/714; 248/73

[58] Field of Search ..... 52/16, 11, 545, 52/547, 555, 714; 248/48.1, 48.2, 49, 65, 67.7, 71, 72, 73

[56] References Cited

U.S. PATENT DOCUMENTS

| | | | |
|---|---|---|---|
| 3,394,519 | 7/1968 | Tischuk | 52/545 |
| 4,114,340 | 9/1978 | Dean et al. | 52/545 |
| 4,632,342 | 12/1986 | Skinner | 248/48.2 |
| 5,024,405 | 6/1991 | McGuire | 248/73 |
| 5,317,843 | 6/1994 | Sheehan | 248/48.2 X |
| 5,326,055 | 7/1994 | Page et al. | 248/74.3 |
| 5,388,377 | 2/1995 | Faulkner | 52/11 |
| 5,406,756 | 4/1995 | Bemis et al. | 248/48.1 X |
| 5,452,743 | 9/1995 | Rortvedt | 248/300 X |
| 5,607,124 | 3/1997 | Earley | 248/48.1 X |

FOREIGN PATENT DOCUMENTS

| | | | |
|---|---|---|---|
| 1188476 | 6/1985 | Canada | 52/16 |
| 5-18069 | 3/1993 | Japan | 52/11 |
| 2022400 | 12/1979 | United Kingdom | 52/16 |

*Primary Examiner*—Michael Safavi

[57] ABSTRACT

A molded plastic attachment clip with a lip at the top and angles leading back to siding, and back again to main body of clip causing a positive lock when inserted into the locking mechanism of vinyl siding, with two foldable arms to hold gutter downspouts in place without nailing or damaging the vinyl siding. This unique locking system allows for easy aligning of downspouts after installation, and does not void the warranty of vinyl siding as does present method of strapping downspouts.

1 Claim, 3 Drawing Sheets

PLASTIC CLIP FOR DOWNSPOUT ATTACHMENT TO VINYL SIDING

BACKGROUND

1. Field of Invention

This invention relates to a method of attaching various gutter downspouts to Vinyl Siding on a building wall.

2. Description of Prior Art

The common practice of attaching downspouts to vinyl siding is to wrap a metal or plastic strap around the downspout and nail or screw through the vinyl siding. This is the method used by all gutter installers. Not only is this unsightly, but it also voids the warranty on each panel of vinyl siding that is so nailed or screwed through.

The characteristics of vinyl siding is such that it has a high rate of expansion and contraction and when a nail or screw is placed through it, this process is hindered thereby voiding the manufacturers warranty.

U.S. Pat. No. 5,326,055 to Page & Santucci (1993) discloses a clip for attaching vertical and horizontal wires and cables to a building wall, but is not designed for downspout attachment and does not have a positive locking system and can come unlocked when weight is applied or when normal expansion or contraction occurs. Other prior art still shows the use of screws or nails to attach a bracket or clamp to vinyl siding, which is totally unacceptable.

OBJECTS AND ADVANTAGES

Accordingly, besides the objects and advantages of the downspout clip described in our above patent, several objects and advantages of the present invention are:

(a) To provide a downspout clip that locks directly into the locking mechanism of the vinyl siding.

(b) To provide a clip that becomes more secure when weight is applied.

(c) To provide a clip that requires no nails or screws to be applied through the vinyl siding, so as to not void the warranty.

(d) To provide a clip that can be easily adjusted to straighten the downspout.

(e) To provide a clip that will move to allow for normal expansion and contraction of vinyl siding.

(f) To provide a clip that can be easily made in colors to match downspouts, or be painted to match (g) To provide a clip that can be easily removed and re-installed in the event downspouts need to be replaced or taken down for any reason.

(h) To provide a clip that can be easily installed by any siding installer, gutter installer, or any home owner.

DRAWING FIGURES

In the drawings, closely related figures have the same number

REFERENCE NUMBERS IN DRAWINGS

12 Lip
14 Angled Bends
16 Foldable Arms
18 Hole
20 Slight Indentation
22 Main Body

DESCRIPTION-FIGS. 1–5

Figure 1:
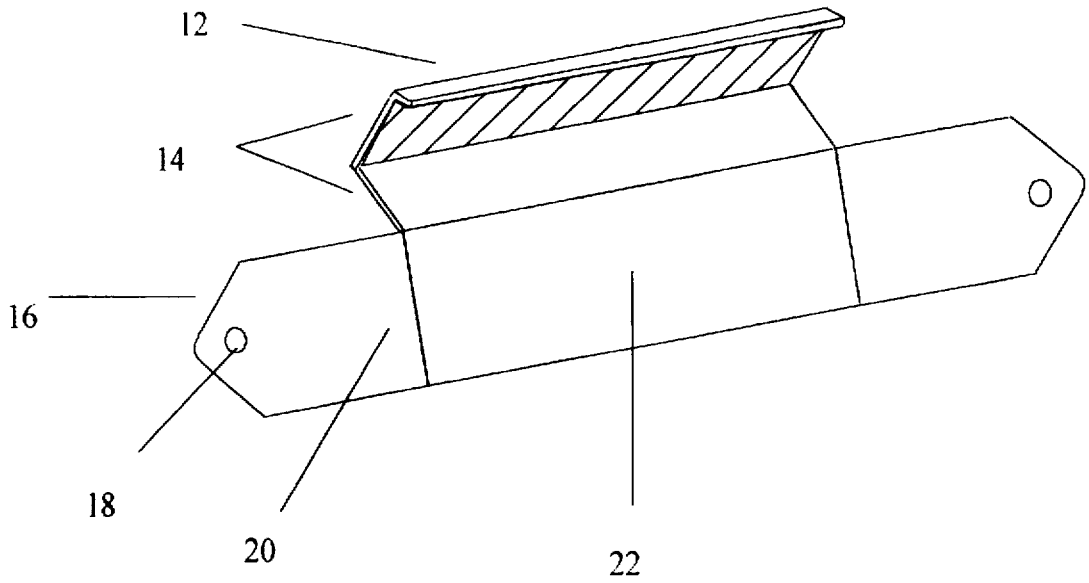
FIG. 1 shows the plastic clip to be used for downspout attachment.

A typical embodiment of the present invention is illustrated in FIG. 1. The entire clip assembly is made of a molded piece of material such as polyethylene or vinyl.

At the top of the clip is a lip 12 that terminates at the beginning of the first of two angle bends 14, that terminate at the main body 22 of the clip. From the slight indentations 20, are the foldable arms 16, each with a hole 18 near the end.

Figure 2:
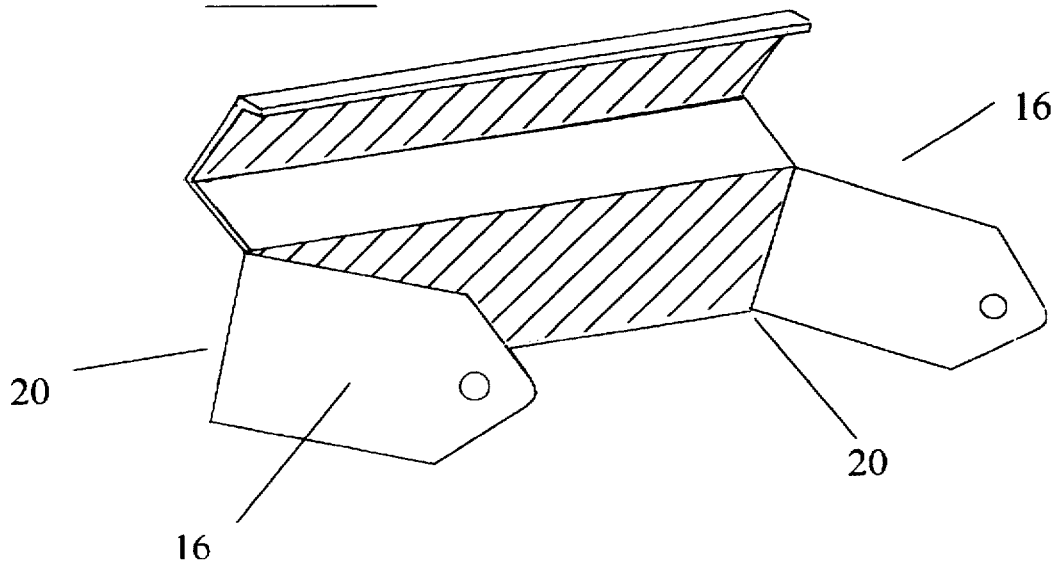
FIG. 2 shows the plastic clip with arms folded to recieve downspout.
Figure 3:
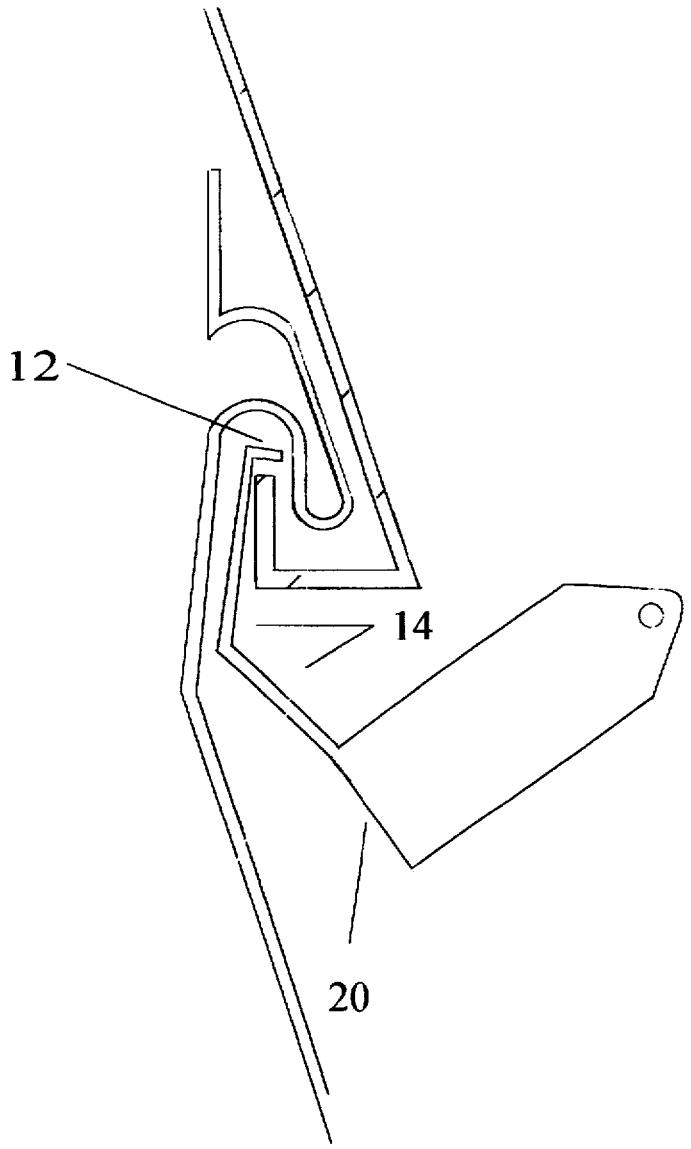
FIG. 3 shows positioning of plastic clip for insertion into vinyl siding lock.
Figure 4:
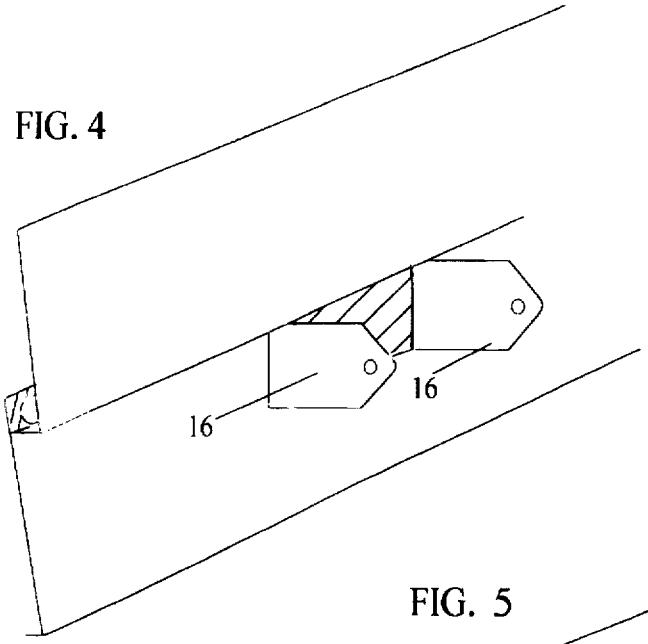
FIG. 4 shows plastic clip after insertion into vinyl siding lock.

FIG. 2 shows the clip with the foldable arms 16 folded at 90 degrees to the main body 22 at the slight indentations 20. Although the foldable arms 16 need to be in the position to recieve the downspout, it is not necessary to fold them until after the clip is snapped into place FIGS. 3–4, because clip can be slid behind downspout if so desired. This is often the case when downspouts are temporarily left in place during rainy weather.

Figure 5:
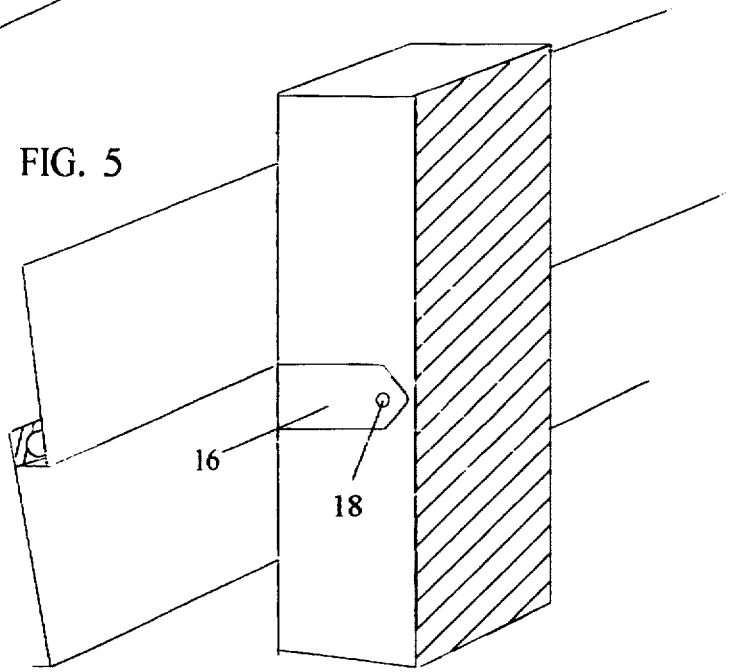
FIG. 5 shows plastic clip with downspout installed.

When the downspout is set in place FIG. 5, it takes only two sheet metal screws through the holes 18 in the foldable arms 16 to attach clip to downspout.

From the above description a number of advantages of our downspout clip become evident:

(a) The use of the downspout attachment clip, eliminates the need to nail, screw or damage in any way the vinyl siding you are attaching the downspout to.

(b) Using the downspout clip maintains the warranty on each panel of vinyl siding that will require a downspout attachment device.

(c) Using the downspout clip makes removing and re-installing the downspout for cleaning or any other reason extremely easy.

(d) With the use of the downspout clip, downspouts may be moved or slid for re-alignment.

(e) Only a small side arm is visable on each side of downspout, when color matched or painted, downspout clip is unnoticeable.

(f) Downspout clip is able to move with normal expansion and contraction of vinyl siding, preventing buckling or damage to siding.

SUMMARY, RAMIFICATIONS, AND SCOPE

Accordingly, the reader will see that the plastic clip for attachment of downspouts to vinyl siding, permits an easy way to solve the many problems associated with downspout attachment:

It is no longer necessary to puncture any holes in vinyl siding to attach a downspout.

It is now possible to install a downspout holding clip before or after the downspout is in place.

With this downspout clip it is now possible to re-align if necessary, an installed downspout without pulling any nails or screws. You simply move the downspout and clip to the position you want.

The downspout clip provides a pleasant looking, secure and efficient way to attach a downspout to vinyl siding.

Although the above description contains many specifications, these do not limit the scope of the invention but merely act as illustrations of some preferred embodiments of this invention. For example, the clips will be molded to exactly match most vinyl siding colors, and can also be painted to match the downspout.

We claim:

1. A one piece plastic mounting clip attaching a vertically disposed gutter downspout to vinyl siding, with said vinyl siding comprising longitudinal overlapping vinyl siding members and defining a longitudinal lock between adjacent vinyl siding members in the region of overlapping;

the mounting clip having a main body portion with a first angled bend extending from the main body portion and a second angled bend extending from the first angled bend, and a lip at the top of the second angled bend positively locking the mounting clip over a bottom longitudinal lock of one of the vinyl siding members, with the vertically disposed gutter downspout attached to the mounting clip by arms extending outwardly from the main body portion of the mounting clip along each side of the gutter downspout.

* * * * *